United States Patent [19]

Gerger

[11] Patent Number: 4,693,593

[45] Date of Patent: Sep. 15, 1987

[54] ELECTROGRAPHIC PROCESS CONTROL

[75] Inventor: Scott A. Gerger, Rochester, N.Y.

[73] Assignee: Eastman Kodak Company, Rochester, N.Y.

[21] Appl. No.: 877,948

[22] Filed: Jun. 24, 1986

[51] Int. Cl.[4] ..... G03G 15/052

[52] U.S. Cl. ..... 355/14 CH; 355/14 R

[58] Field of Search ..... 355/14 R, 14 CH, 14 C, 355/14 E, 14 D, 3 R, 3 CH

[56] References Cited

U.S. PATENT DOCUMENTS

| | | | |
|---|---|---|---|
| 3,650,624 | 3/1972 | Yamada | 355/69 |
| 3,679,306 | 7/1972 | Du Bois et al. | 355/11 X |
| 3,738,242 | 6/1973 | Lee et al. | 355/69 X |
| 3,788,739 | 1/1974 | Coriale | 355/3 R |
| 4,204,725 | 5/1980 | Di Stefano et al. | 355/14 CH |
| 4,355,885 | 10/1982 | Nagashima | 355/14 CH |
| 4,408,871 | 10/1983 | Kojima | 355/14 R |
| 4,417,804 | 11/1983 | Werner, Jr. | 355/14 CH |
| 4,432,634 | 2/1984 | Tabuchi | 355/14 D |
| 4,433,297 | 2/1984 | Buchheit | 355/14 CH |
| 4,502,778 | 3/1985 | Dodge et al. | 355/14 E |
| 4,512,652 | 4/1985 | Buck et al. | 355/14 CH |
| 4,647,184 | 3/1987 | Russell et al. | 355/14 CH |

*Primary Examiner*—R. L. Moses

*Attorney, Agent, or Firm*—Milton S. Sales

[57] ABSTRACT

An electrographic device that uses a chargeable image transfer member with at least one image area and has means for adjusting at least one process parameter in response to changes in the sensitometric characteristics of the image transfer member as measured in a portion of the image transfer means outside of the image area is disclosed. The device is provided with transfer member discharging means for subjecting the portion of the transfer member to a history of being charged and discharged substantially the same as the history of the image area of the transfer member. Preferably, the image transfer member is a photoconductor and the discharging means includes a light source and means for modulating said light source to statistically imitate a predetermined mix of original document types in response to at jobstream estimates, key operator input, and user selection.

5 Claims, 2 Drawing Figures

ELECTROGRAPHIC PROCESS CONTROL

BACKGROUND OF THE INVENTION

1. Field of the Invention

The present invention relates to automatic control of electrographic copier and/or printer devices, and more particularly to automatic compensation for changes in the sensitometric characteristics of the image transfer member of such devices.

2. Description of the Prior Art

In electrographic devices such as copiers and/or printers, control of image contrast is desired to produce images having constant and predeterminable quality. The term "contrast" as used herein refers to the rate of change of the output image density $D_{out}$ with respect to the input image density $D_{in}$. Process parameters which determine image contrast include the voltage applied to the image transfer member by the primary charger, the intensity of image exposure, the bias voltage applied to the development station, and the image transfer potential.

Image contrast is also very much affected by the amount of change in transfer member voltage as a function of exposure, known as the "sensitometric characteristic" of the image transfer member. Sensitometric data is sometimes produced by the use of process patches exposed on portions of the transfer member outside image areas thereof. However, such methods have proven to be only partially successful because the data is received from a portion of the transfer member which has not been subjected to the same history of being charged and discharged as has the image areas; and the sensitometric characteristics of the transfer member is greatly influenced by such history.

SUMMARY OF THE INVENTION

In accordance with the present invention, an electrographic device that measures the sensitometric characteristics of a portion of the image transfer member outside of image areas is provided with means for subjecting that portion of the image transfer member to a history of being charged and discharged substantially the same as the history of the image area of the transfer member.

In a preferred embodiment, the image transfer member is a photoconductor and the discharging means includes a light source and means for modulating said light source to statistically imitate a predetermined mix of original document types in response to jobstream estimates, key operator input, and user selection.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DETAILED DESCRIPTION OF THE PREFERRED EMBODIMENT

Figure 1:
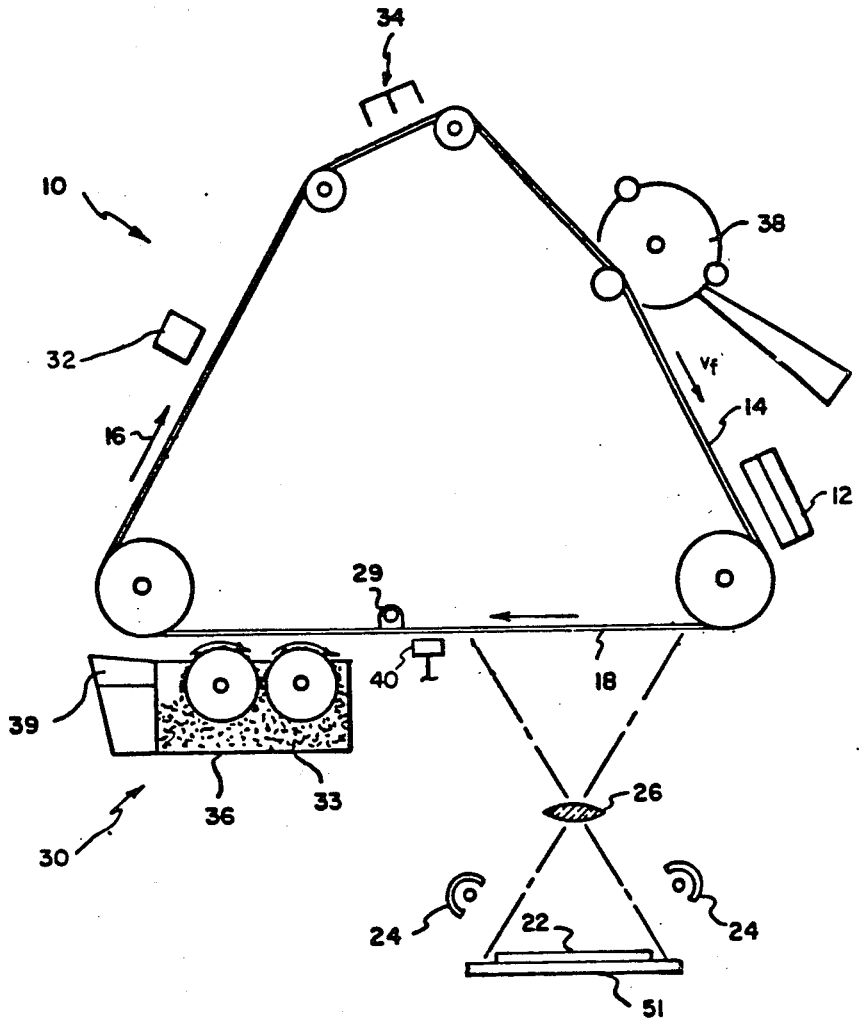
FIG. 1 is a schematic vertical selection of an electrophotographic copier device including process control in accordance with the present invention.

To assist in understanding the present invention, an exemplary electrophotographic copy machine 10 in which the invention may be used will be briefly described with reference to FIG. 1. It will be understood, however, that apparatus in accordance with the present invention can be used in other types of machines.

Copy machine 10 includes a charger 12 which is effective to apply a uniform primary charge on an image transfer member such as transparent photoconductor 14. The photoconductor is an endless web trained about a plurality of rollers and driven at a uniform velocity $V_f$ in the direction indicated by an arrow 16. Photoconductor 14 may comprise a layer of photoconductive material at, or adjacent to, the outwardly facing surface of the web, and a conductive backing or support layer on the backside of the web.

An information medium such as an original document 22 is illuminated by radiation from main exposure flash lamps 24. The radiation is reflected from the document and projected by a lens 26 onto image areas on the surface 18 of the photoconductor member. The radiation striking the charged photoconductor member selectively dissipates portions of the charge to form an electrostatic latent image on surface 18. The image areas on surface 18 are spaced slightly from each other along the length of the web to create interframe regions. The non-image areas may be selectively discharged by format erase lamp 29.

A magnetic brush development station 30 receives a supply of developer mixture 33 comprising, for example, toner particles and carrier particles. Magnetic development brushes carry toner particles to the latent image. Station 30 also includes a toner replenishment 39 which is adapted to furnish new toner to a reservoir 36 beneath the brushes.

After passing a post development erase lamp 32, the toner image is transferred at a transfer station 34 to a copy sheet fed from a paper supply, not shown. The image is fused to the copy sheet in any conventional manner. The photoconductor member is cleaned in a station 38, and is then available for another cycle of operation.

An electrophotographic machine as generally described hereinbefore is disclosed in more detail in commonly assigned U.S. Pat. No. 4,141,645, issued Feb. 27, 1979 to M. G. Reid et al. Reference is made to such patent for a more complete description of the machine and its operation.

Figure 2:
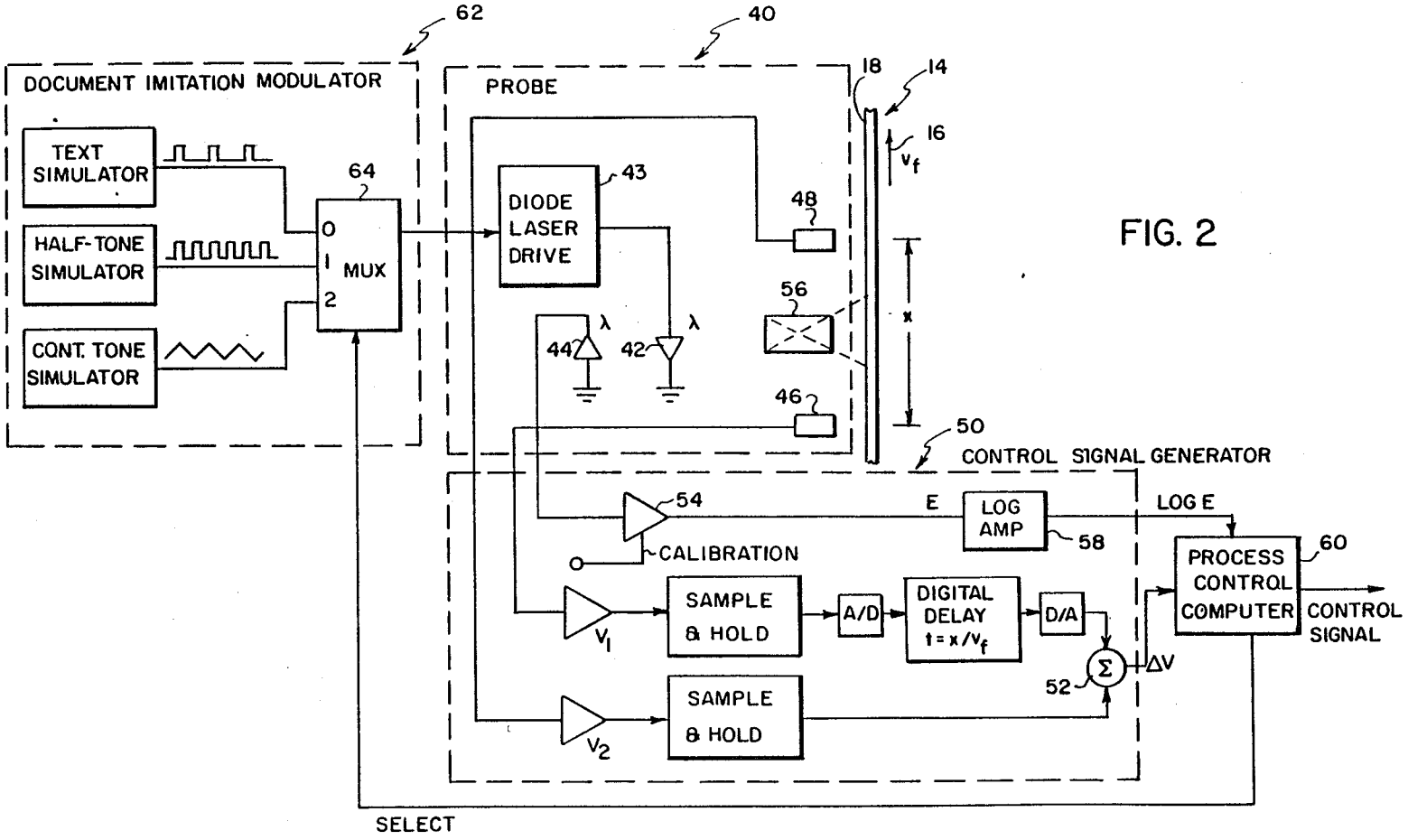
FIG. 2 is a block diagram showing process control apparatus in accordance with a preferred embodiment of the present invention.

A probe 40 is positioned adjacent to surface 18 of photoconductor 14 so as to be optically and electrostatically coupled to the surface. Details of the inputs and outputs of the probe will be explained with reference to FIG. 2. The probe includes a light source such as a light emitting diode (LED) or, as illustrated, a solid state diode laser 42 with a laser driver 43. Light from the laser falls on surface 18 of photoconductor 14, and also on a photodetector 44. A pair of electrometers 46 and 48 with output signals $V_1$ and $V_2$, respectively are positioned adjacent to surface 18 of photoconductor 14. Outputs of the electrometers represent the surface potential of photoconductor region therebelow. That is, output signal $V_1$ represents the photoconductor surface potential before laser 42, and output signal $V_2$ represents the potential after the laser.

Signals $V_1$ and $V_2$ are applied to a control signal generator 50, wherein they are amplified and converted to digital form. Converted signal $V_1$ is delayed a suitable period such that the signal $V_2$ from a particular segment of photoconductor 14 can be subtracted from the signal $V_1$ of the same sector by a summing amplifier 52 to generate a control signal $\Delta V$.

Control signal generator 50 also receives a signal from photodetector 44, which signal is related to the intensity of the exposure of photoconductor 14 by diode laser 42. The signal is calibrated by an amplifier 54 to adjust for optical attenuation and other factors associated with optical path 56 of probe 40. The output E of amplifier 50 is applied to a logarithmic amplifier 54 to create a control signal log E.

Control signals $\Delta V$ and log E from control signal generator 50 are applied to a process control computer 60. The computer uses the control signals along with adjustment factors which can be entered at during manufacture or by service representatives, key operators, or users to effect the image contrast of the copier by adjusting the primary charge, exposure, development, and/or transfer stations' operation.

Because the portion of photoconductor 14 exposed to laser 42 and sensed by electrometers 46 and 48 is not in the image area of photoconductor 14, the portion is not subjected to the same history of being charged and discharged as has the image area portion on the photoconductor. As used herein, "history of being charged and discharged," X refers to the level of charge, the level of discharge, the time duration of charge, and the number of charging and discharging cycles. The $\Delta V$ and log E control signals are generated by means of a document imitation modulator 62 from portions of photoconductor 14 that have been exercised in a fashion similar to the image areas. In general, during operation, diode laser 42 is modulated to statistically imitate a predetermined mix of original document types such as originals containing text, continuous tone images, and half-tone images.

A plurality of waveform generators are provided as inputs to a multiplexer 64. Each generator is adapted to create a waveform particular to a particular document type. For example, a text simulation generator 66 might create low duty-cycle pulses, a continuous tone simulation generator might create saw-tooth waveforms, and a half-tone simulation generator might create high-frequency pulses. The exact character of the waveforms for various document types is readily determinable by analysis of typical original documents.

The mix of waveforms chosen by multiplexer 64 is computer controlled by process control computer 60 based on statistical jobstream estimates, key operator input, or user selection; but the goal is to approximate or substantially duplicate the original document mix being copied. In this manner, the portion of the photoconductor being tested is exercised in a way similar to the usual image area.

The invention has been described with particular reference to a preferred embodiment thereof, but it will be understood that variations and modifications can be effected within the spirit and scope of the invention.

I claim:

1. In an electrographic device that uses a chargeable image transfer member with at least one image area and has means for adjusting at least one process parameter in response to changes in the sensitometric characteristics of the image transfer member as measured in a portion of the image transfer member outside of the image area; the improvement comprising transfer member discharging means for subjecting said portion of the transfer member to a history of being charged and discharged substantially the same as the history of the image area of the transfer member.

2. The improvement as defined in claim 1 wherein:

said image transfer member is a photoconductor; and said discharging means includes a light source and means for modulating said light source to imitate original documents.

3. The improvement as defined in claim 1 wherein:

said image transfer member is a photoconductor; and said discharging means includes a light source and means for modulating said light source to statistically imitate a predetermined mix of original document types.

4. The improvement as defined in claim 3 wherein said modulating means includes means for varying said predetermined mix in response to at least one of jobstream estimates, key operator input, and user selection.

5. The improvement as defined in claim 1 wherein said means for adjusting at least one process parameter includes;

means for generating a control signal having a characteristic related to the sensitometric characteristics of the image transfer member portion; and a process control computer responsive to said control signal for adjusting the process parameter.

* * * * *

UNITED STATES PATENT AND TRADEMARK OFFICE

CERTIFICATE OF CORRECTION

PATENT NO. : 4,693,593

DATED : September 15, 1987

INVENTOR(S) : Scott A. Gerger , et al

It is certified that error appears in the above-identified patent and that said Letters Patent is hereby corrected as shown below:

On the title page, Item (19) should read -- Gerger, et al --.

Item (75) inventor should read -- Scott A. Gerger and Dennis A. Kenyon --.

Signed and Sealed this

Sixteenth Day of February, 1988

*Attest:*

*Attesting Officer*

DONALD J. QUIGG

*Commissioner of Patents and Trademarks*